US008119917B2

(12) United States Patent
King

(10) Patent No.: US 8,119,917 B2
(45) Date of Patent: Feb. 21, 2012

(54) BRAIDED CABLE

(76) Inventor: Samuel John Edward King, Singapore (SG)

( * ) Notice: Subject to any disclaimer, the term of this patent is extended or adjusted under 35 U.S.C. 154(b) by 153 days.

(21) Appl. No.: 12/584,750

(22) Filed: Sep. 11, 2009

(65) Prior Publication Data

US 2011/0061889 A1 Mar. 17, 2011

(51) Int. Cl.
*H01B 7/00* (2006.01)

(52) U.S. Cl. ..... 174/113 R

(58) Field of Classification Search ..... 174/113 R, 174/121 R, 122 R, 124 R
See application file for complete search history.

(56) References Cited

U.S. PATENT DOCUMENTS 3,742,363 A * 6/1973 Carle ..... 174/102 R
5,705,774 A * 1/1998 Beauchamp ..... 174/121 R
6,038,330 A * 3/2000 Meucci, Jr. ..... 381/371
7,692,099 B2 * 4/2010 Burke ..... 174/113 R
2001/0032732 A1 * 10/2001 Fujino et al. ..... 174/106 R
2007/0079695 A1 * 4/2007 Bucher et al. ..... 87/8
2008/0255435 A1 * 10/2008 Al-Ali et al. ..... 600/323

* cited by examiner

*Primary Examiner* — Chau Nguyen
(74) *Attorney, Agent, or Firm* — Leif R. Sloan; Sonya C. Harris; Axis Intellectual Capital Pte Ltd

(57) ABSTRACT

A cable including a number of cords of wires. The cords of wires are braided together in a predetermined braiding pattern. Each cord of wires includes a number of wires. The wires of each cord of wires are braided together in a predetermined braiding pattern. The cable further includes a cable insulator that collectively encapsulates the cords of wires. The cable further includes cord insulators. Each cord insulator collectively encapsulates the wires of each cord of wires. Each wire is encapsulated within a wire insulator. At least one of the cable insulator, the cord insulator, and the wire insulator is braided in a predetermined braiding pattern. The braiding of the cords of wires, the wires of each cord of wires, the cable insulator, the cord insulator, and the wire insulator, enhances at least one of flexibility and tensile strength of the cable. The braiding of the cords of wires, the wires of each cord of wires, the cable insulator, the cord insulator, and the wire insulator preferably decreases propensity of kink formation in the cable. A method for manufacturing cables is also provided by the present disclosure.

19 Claims, 4 Drawing Sheets

BRAIDED CABLE

FIELD OF DISCLOSURE

The present disclosure relates generally to cables. More specifically, the present disclosure relates to cables that are manufactured using braiding processes, methods, or techniques.

BACKGROUND

A computer mouse typically facilitates translation of a two-dimensional movement of the computer mouse into a pointer or cursor movement on a display medium, for example a computer display screen. The two-dimensional movement of the computer mouse is typically effected by a user's hand. The two-dimensional movement of the computer mouse is converted by the computer mouse, more specifically by a controller of the computer mouse, into electrical signals. The electrical signals are transmitted via a computer mouse cord or a computer mouse cable to a computer, where the electrical signals are then processed and utilized for effecting the pointer movement on the display medium.

The computer mouse cord or computer mouse cable typically includes a number of wires or optical fibers that are bound together and collectively insulated in a common protective sheath or jacket (also known as a cable insulator). Individual wires within the common protective sheath of the computer mouse cable may also be individually insulated. Wires are typically elongated strings of drawn metal or metal alloy, which are typically used for transmission of electricity as well as telecommunication and electrical signals.

Wires can be manufactured or constructed from a wide variety of different metals and metal alloys. Generally, such metals and metal alloys used to manufacture wires must be ductile and of sufficient tensile strength. Some metals conventionally used for the manufacture of wires include copper, aluminum, silver and platinum. In addition, metal alloys such as brass and bronze have been used for the manufacture of wires.

Wires may be classified as solid wires, which are also known as solid-core wires, or stranded wires. Likewise, cables may be classified as solid cables, which are also known as solid-core cables, or stranded cables. Solid wires and solid cables are typically cheaper to manufacture. However, solid wires and solid cables generally lack adequate flexibility. Electrical wires and cables (e.g., computer mouse cables) are typically stranded. Stranded cables include multiple individual wires. Stranded wires include multiple smaller wires that are bundled together. Stranded cables and stranded wires are typically more flexible than solid cables and solid wires of similar sizes. However, increased 'skin effect' (a phenomenon whereby current travels near the surface of wires thereby resulting in power loss in wires) may be observed with such stranded cables and stranded wires due to an increased average resistivity that results from inclusion of air gaps between their multiple individual components.

Stranded cables and stranded wires are commonly used with electrical applications that carry small signals, for example with computer mouse cables and with power cables that interconnect moveable devices and their power source.

Computer mouse cables typically need to be significantly flexible to accommodate movement made to the computer mice attached thereto. Increased flexibility of computer mouse cables is increasingly important, and of concern, to garners needing to make quick and precise computer mouse movements so as to effect quick and precise pointer movements on the display screen.

It is a challenge to continually increase the flexibility of computer mouse cables. In addition, kink formation is common in existing computer mouse cables. This is due to inherent cable memories, or wire memories, of the existing computer mouse cables and the wires thereof. Computer mouse cables with kinks formed therein are generally not aesthetically pleasing. In addition, kinked computer mouse cables may not function optimally.

SUMMARY

The present disclosure describes cables, as well as methods, processes, and techniques for manufacture of the cables. Cables provided by the present disclosure are designed for at least one of enhanced flexibility and reduced propensity for kink formation.

In accordance with a first aspect of the present disclosure, there is provided a cable including a braided cable insulator and a plurality of wires carried by the braided cable insulator. The plurality of wires is spatially organized relative to each other in a predetermined braiding pattern. At least one of the plurality of wires includes a braided wire insulator. The spatial organization of the plurality of wires, the braided wire insulator, and the braided cable insulator at least one of enhances flexibility, increases tensile strength, and reduces a propensity of kink formation of the cable.

In accordance with a second aspect of the present disclosure, there is disclosed a cable including a plurality of cords of wires braided together in a first braiding pattern. Each cord of wires within the plurality of cords of wires includes a plurality of wires braided together in a second braiding pattern. The first braiding pattern and the second braiding pattern facilitate at least one of enhanced flexibility, increased tensile strength, and a reduced propensity of kink formation of the cable In accordance with a third aspect of the present disclosure, there is disclosed a method for manufacturing a cable, the method including braiding a plurality of wires in a predetermined pattern, and providing a plurality of braided wire insulators, each braided wire insulator within the plurality of wire insulators at least partially surrounding one of the plurality of wires. The method further includes providing a braided cable insulator for circumferentially receiving the plurality of wires therewithin. The braiding of the plurality of wires, the plurality of braided wire insulators, and the braided cable insulator facilitates at least one of enhancing flexibility, increasing tensile strength, and reducing a propensity of kink formation of the cable.

In accordance with a fourth aspect of the present disclosure, there is disclosed a method for manufacturing a cable, the method including braiding a plurality of wires for forming a plurality of cords of wires, each cord of wires within the plurality of cords of wires comprising a subset of the plurality of wires, and braiding the plurality of cords of wires in a predetermined braiding pattern. The braiding of the plurality of wires and the braiding of the plurality of cords of wires facilitates at least one of enhancing flexibility, increasing tensile strength, and reducing a propensity of kink formation, of the cable.

In accordance with a fifth aspect of the present disclosure, there is disclosed a computer peripheral device that includes a housing, a set of transducers carried by the housing, and a set of electrical interface coupled to the set of transducers and carried by the housing. The computer peripheral device further includes a cable coupled to the electrical interface. The cable includes a braided cable insulator and a plurality of wires disposed within the braided cable insulator and spatially organized relative to each other in a predetermined braiding pattern. At least one of the plurality of wires includes a braided wire insulator. The braiding pattern of the plurality of wires, the braided cable insulator, and the braided wire insulator at least one of enhances flexibility, increases tensile strength, and reduces a propensity of kink formation of the cable.

In accordance with a sixth aspect of the present disclosure, there is disclosed a computer peripheral device that includes a housing, a set of transducers carried by the housing, and a set of electrical interface coupled to the set of transducers and carried by the housing. The computer peripheral device further includes a cable coupled to the electrical interface. The cables includes a plurality of cords of wires braided together in a first braiding pattern, each cord of wires within the plurality of cords of wires including a plurality of wires that are braided together in a second braiding pattern. The first braiding pattern and the second braiding pattern facilitate at least one of enhanced flexibility, increased tensile strength, and a reduced propensity of kink formation of the cable.

BRIEF DESCRIPTION OF THE DRAWINGS

Embodiments of the disclosure are described herein with reference to the drawings, in which.

DETAILED DESCRIPTION

Figure 1A:
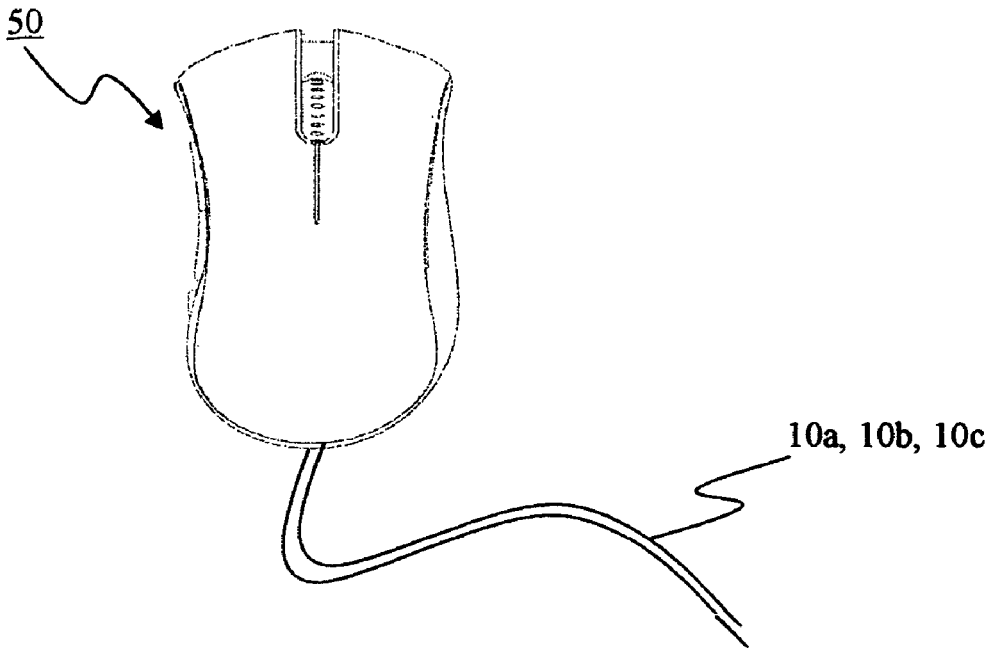
FIG. 1*a* shows a computer mouse cable attached to a computer mouse according to an embodiment of the present disclosure.

A computer mouse cable is typically a stranded cable (i.e., includes multiple wires). The computer mouse cable generally needs to be flexible and of adequate tensile strength.

Enhancing the flexibility of computer mouse cables is increasingly important, especially for garners wanting to make quick and precise movements to the computer mouse for effecting quick and precise pointer movements on a display screen. Embodiments of the present disclosure provide cables (e.g., cables attaches to computer peripheral devices such as computer mice and headsets) of enhanced design and construction for enabling at least one of enhanced flexibility and tensile strength.

For purposes of brevity and clarity, embodiments of the present disclosure are described herein as cables of computer peripheral devices (e.g., computer mice and headsets) as well as methods, processes, and techniques for manufacturing said cables. This however does not preclude the present disclosure from other applications where fundamental principles prevalent among the described embodiments of the present disclosure, such as operational, functional or performance characteristics, are required. For example, the present disclosure includes alternative types or models of cables and cords, which can be used with other types of electrical appliances or devices. The present disclosure also includes methods, processes, and techniques for the manufacture of such alternative types or models of cables and cords.

For simplicity and clarity of illustration, various embodiments of the present disclosure are described hereinafter with reference to FIG. 1 to FIG. 5, in which like elements are numbered with like reference numerals.

Figure 1B:
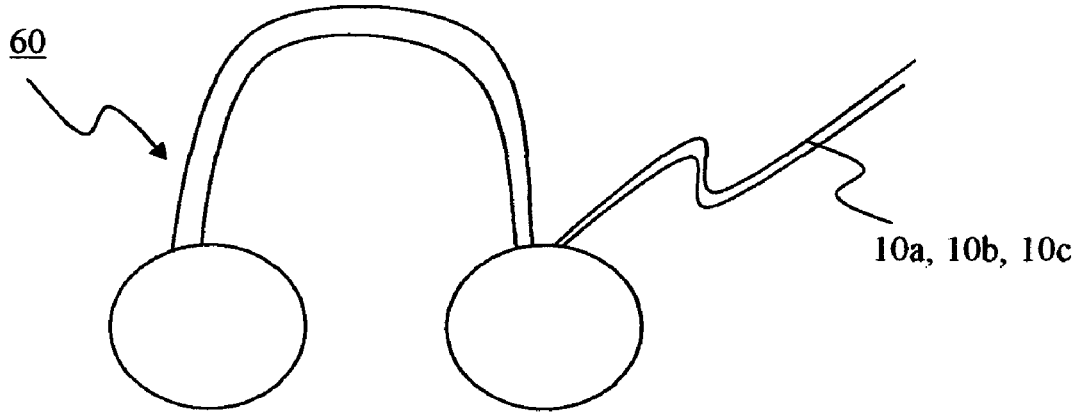
FIG. 1*b* shows a cable attached to a headset according to an embodiment of the present disclosure.

Each of FIG. 1*a* and FIG. 1*b* shows a cable 10*a*, 10*b*, 10*c* according to the present disclosure that is attached to a computer peripheral device, for example a computer mouse 50 and a headset 60. It will be understood by a person of ordinary skill in the art that the cable 10*a*, 10*b*, 10*c* can be attached to an alternative electrical appliance (e.g., a microphone).

In most embodiments, the computer peripheral device (e.g., the computer mouse 50 or the headset 60) includes a housing, a set of transducers carried by the housing, and a set of electrical interfaces (e.g., coupling structures that facilitate electrical path conductivity) coupled to the set of transducers and carried by the housing. The cable 10*a*, 10*b*, 10*c* is attached or coupled to the set of electrical interfaces of the computer peripheral device by techniques known in the art.

In some embodiments, input (e.g., movement) received by the computer peripheral device (e.g., the computer mouse 50) is translated by the set of transducers into signals, which are subsequently transmitted to the cable 10*a*, 10*b*, 10*c* via the electrical interface.

In several embodiments, the signals are transmitted by the cable 10*a*, 10*b*, 10*c* to a controller or computer, which the cable is in signal communication with, for effecting a number of outputs. Such outputs include, but are not limited to, movement of a cursor, or other pointing tool, displayed on a display screen, volume adjustments, and display screen brightness adjustments.

Figure 2:
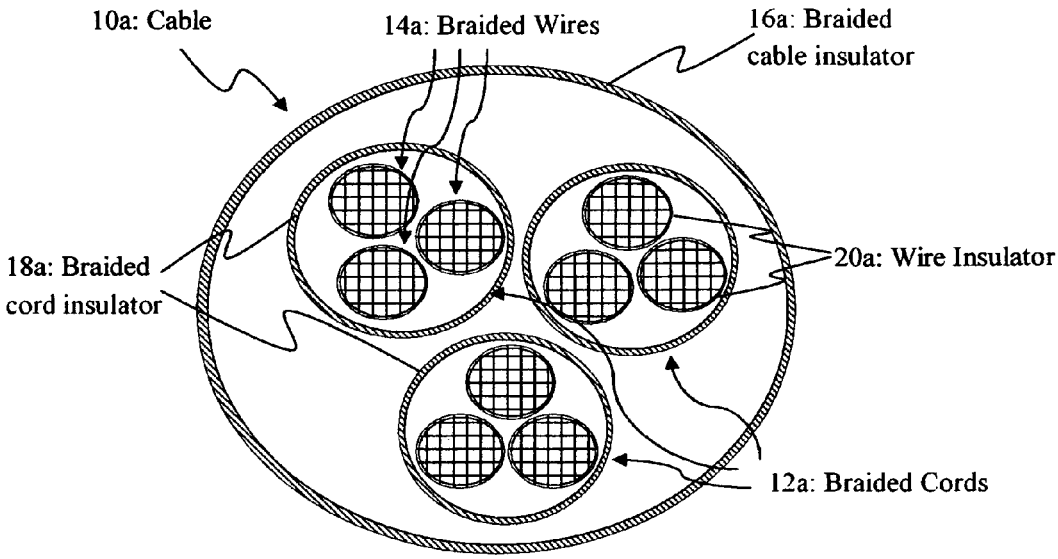
FIG. 2 shows a computer mouse cable according to an embodiment of the present disclosure.

FIG. 2 shows the cable 10*a* according to an embodiment of the present disclosure. In most embodiments of the present disclosure, the cable 10*a* is coupled or attached or coupled to a computer peripheral device, for example the computer mouse 50 or the headset 60 (alternatively referred to as a set of headphones).

In most embodiments of the present disclosure, the cable 10*a* is a computer mouse cable or a computer mouse cord. As shown in FIG. 2, the cable 10*a* includes a number of bundles of wires. Each of the number of bundles of wires is hereinafter referred to as a cord of wires 12*a*. In many embodiments, the cable 10*a* includes two, three, four or five cords of wires 12*a*. In other embodiments, the cable 10*a* includes more than five cords of wires 12*a*. Each cord of wires 12*a* includes a number of individual wires 14*a*.

The cable 10*a* further includes an insulating layer or an insulating sheath, which is hereinafter referred to as a cable insulator 16*a*. In most embodiments of the present disclosure, the cable insulator 16*a* is shaped and dimensioned for receiving the cords of wires 12*a*. In most embodiments of the present disclosure, the cable insulator 16*a* circumferentially surrounds at least part of the cords of wires 12*a*. In several embodiments of the present disclosure, the cable insulator 16*a* wraps around, encapsulates, encloses, or carries the cords of wires 12*a* therewithin.

The cable insulator 16*a* of the cable 10*a* shown in FIG. 2 is made of a material that is braided or woven in a predetermined pattern (i.e., the cable insulator 16*a* is a braided cable insulator 16*a*). In most embodiments, the material of the cable insulator 16*a* is electrically non-conductive. In most embodiments of the present disclosure, the material of the cable insulator 16*a* is selected based on at least one of cost, aesthetic properties, and resistance to at least one of water, oil, impact, high temperatures, and chemical vapors. In some embodiments of the present disclosure, the cable insulator 16*a* is manufactured or constructed from flexible composite polymer materials. In other embodiments of the present disclosure, the cable insulator 16*a* is manufactured from other materials known in the relevant art, for example polyvinyl chloride (PVC), magnesium oxide, and rubber.

In most embodiments of the present disclosure, the cable insulator 16*a* (i.e., the material of the cable insulator 16*a*) can have different braiding patterns or styles (also known as weaving patterns or styles). In most embodiments of the present disclosure, the braiding pattern or style of the cable insulator 16*a* is selected with reference to physical or electrical properties that are associated with the different braiding patterns. For example, a particular braiding pattern may be associated with, or may provide or confer upon the cable insulator 16*a*, and correspondingly the cable 10*a*, a different tensile strength or flexibility. In addition, a particular braiding pattern may be associated with, or may provide or confer upon the cable insulator 16*a*, and correspondingly the cable 10*a*, a different propensity for kink formation (e.g., a different capacity or level of cable memory).

In most embodiments of the present disclosure, the braiding pattern of the cable insulator 16*a* is selected for enhancing at least one of flexibility and tensile strength of the cable 10*a*. In several embodiments of the present disclosure, the braiding pattern of the cable insulator 16*a* is further selected for enhancing aesthetic properties of the cable insulator 16*a*. In various embodiments of the present disclosure, the braiding pattern of the cable insulator 16*a* is selected for reducing a propensity of kink formation of the cable 10*a* (e.g., by reducing the capacity or level of cable memory).

Braiding, which is also known as a braiding process, a braiding method, or a braiding technique, involves intertwining elongate material such that the elongate material takes on a structured pattern, which is typically referred to as a braiding pattern. Some common braiding patterns include, but are not limited to, French braids, Kumihimo braids and Finger-loop braids. There are other braiding patterns that are known in different technical fields.

The embodiment of the cable 10*a* as shown in FIG. 2 includes multiple cords of wires 12*a* that are braided or woven together. The braiding pattern or braiding style of the braided multiple cords of wires 12*a* can be varied as required. In most embodiments of the present disclosure, the braiding pattern of the multiple cords of wires 12*a* is selected for enhancing at least one of flexibility and tensile strength of the cable 10*a*. In various embodiments of the present disclosure, the braiding pattern of the cords of wires 12*a* is selected for further reducing a propensity of kink formation of the cable 10*a* (e.g., by reducing the capacity or level of cord or cable memory).

As shown in FIG. 2, each cord of wires 12*a* includes multiple wires 14*a*. In most embodiments of the present disclosure, each cord of wires 12*a* includes three wires 14*a*. In other embodiments of the present disclosure, each cord of wires 12*a* includes four, five, six, or more wires 14*a*.

In most embodiments of the present disclosure, the wires 14*a* of each cord of wires 12*a* are braided or woven together in a predetermined braiding pattern. The braiding pattern of the wires 14*a* of each cord of wires 12*a* can be selected, and varied, as required. In some embodiments of the present disclosure, the braiding pattern of the wires 14*a* of each cord of wires 12*a* is selected for enhancing at least one of flexibility and tensile strength of the cable 10*a*. In various embodiments of the present disclosure, the braiding pattern of the wires of each cord of wires 12*a* is selected for further reducing a propensity of kink formation of the cable 10*a* (e.g., by reducing the capacity or level of cord or cable memory).

In the embodiment of the present disclosure as shown in FIG. 2, each cord of wires 12*a* has an insulation layer or an insulation sheath, which is hereinafter referred to as a cord insulator 18*a*. In most embodiments of the present disclosure, the cord insulator 18*a* is shaped and dimensioned for receiving the cord of wires 12*a* therewithin. In many embodiments of the present disclosure, the cord insulator 18*a* circumferentially receives at least part of the cord of wires 12*a* therewithin. In some embodiments of the present disclosure, the cord insulator 18*a* wraps around or encapsulates the wires 14*a* of each cord of wires 12*a*. In several embodiments of the present disclosure, the cord insulator 18*a* insulates the wires 14*a* encapsulated therewithin (e.g., the cord insulator 18*a* is made of electrically non-conductive material to thereby electrically insulate the wires 14*a* that are encapsulated therewithin).

In most embodiments of the present disclosure, the cord insulator 18*a* is manufactured or constructed from a material that is braided or woven in a predetermined pattern (i.e., the cord insulator 18*a* is a braided cord insulator 18*a*). The braiding pattern or style of the cord insulators 18*a* can be selected and varied as required. In most embodiments of the present disclosure, the braiding pattern of cord insulator 18*a* is selected for enhancing at least one of flexibility and tensile strength of the cable 10*a*. In various embodiments of the present disclosure, the braiding pattern of the cord insulator 18*a* is selected for further reducing propensity of kink formation to the cable 10*a* (e.g., by reducing the capacity or level of cord or cable memory).

In the embodiment of the present disclosure as shown in FIG. 2, each wire 14*a* includes an insulation layer or an insulation sheath, which is hereinafter referred to as a wire insulator 20*a*. In most embodiments of the present disclosure, the wire insulator 20*a* is shaped and dimensioned for receiving one wire 14*a* therewithin. In many embodiments of the present disclosure, the wire insulator 20*a* circumferentially receives at least part of the one wire 14*a* therewithin. In several embodiments of the present disclosure, the wire insulator 20*a* wraps around or encapsulates at least part of the one wire 14*a*.

In most embodiments of the present disclosure, the wire insulator 20*a* is manufactured or constructed from a material that is braided or woven in a predetermined pattern (i.e., the wire insulator 20*a* is a braided wire insulator 20*a*). The braiding pattern or style of the wire insulator 20*a* can be selected and varied as required. In some embodiments of the present disclosure, the braiding pattern of wire insulator 20*a* is selected for enhancing at least one of flexibility and tensile strength of the cable 10*a*. In various embodiments of the present disclosure, the braiding pattern of the wire insulator 20*a* is selected for further reducing propensity of kink formation to the cable 10*a*.

In some embodiments of the present disclosure, the braiding pattern of each of the cable insulator 16*a*, the cord insulator 18*a*, and the wire insulator 20*a* is identical or similar. In other embodiments of the present disclosure, the braiding pattern of each of the cable insulator 16*a*, the cord insulator 18*a*, and the wire insulator 20*a* is different from at least one of the others. As described above, the braiding pattern of the each of the cable insulator 16*a*, the cord insulator 18*a*, and the wire insulator 20*a* can be selected and varied as required.

In some embodiments of the present disclosure, the cable insulator 16*a*, the cord insulator 18*a*, and the wire insulator 20*a* are manufactured from an identical or similar material. In other embodiments of the present disclosure, the cable insulator 16*a*, the cord insulator 18*a*, and the wire insulator 20*a* are manufactured from different materials. In some embodiments, the material of each of the cable insulator 16*a*, the cord insulator 18*a*, and the wire insulator 20*a* is selected to at least one of enhance flexibility, enhance tensile strength, and reduce propensity to kink formation of the cable 10*a*.

As described above, the embodiment of the cable 10*a* as shown in FIG. 2 has multiple braiding layers. The cable 10*a* includes multiple cords of wires 12*a* that are braided together. Each cord of wires 12*a* further includes multiple wires 14*a* that are braided together. In addition the cable 10*a* includes the cable insulator 16*a*, the cord insulator 18*a*, and the wire insulator 20*a*. In most embodiments of the present disclosure, each of the cable insulator 16*a*, the cord insulator 18*a*, and the wire insulator 20*a* is manufactured from a braided material (i.e., each of the cable insulator 16*a*, the cord insulator 18*a*, and the wire insulator 20*a* are braided insulators). In most embodiments of the present disclosure, the cable insulator 16*a*, the cord insulator 18*a*, and the wire insulator 20*a* are each braided in a predetermined braiding pattern. In most embodiments of the present disclosure, the multiple braiding layers of the cable 10*a* increase the overall flexibility of the cable 10*a*. In some embodiments of the present disclosure, the multiple braiding layers increases tensile strength of the cable 10*a*. In several embodiments of the present disclosure, the multiple braiding layers of the cable 10*a* decreases propensity of kink formation in the cable memory, or reduces cable memory of the cable 10*a*.

Tensile strength, which is generally measured in $N/cm^2$, can be defined according to one of yield strength, ultimate strength, and breaking strength. The yield strength typically refers to a value of stress at which the stress applied to a material results in a change from elastic deformation to plastic deformation of the material (i.e., causes the material to deform permanently). The ultimate strength of a material is typically a maximum stress that the material can withstand when subjected to tension, compression, or shearing forces. The breaking strength typically refers to the stress coordinate on a stress-strain curve at the point of breakage or rapture of the material.

In some embodiments of the present disclosure, increase in tensile strength of the cable 10*a* due to the presence of multiple braiding layers is between approximately 10% and 200% as compared with cables to which no braiding processes or techniques have been applied (e.g., to cables without braiding layers). In other embodiments of the present disclosure, the increase in tensile strength of the cable 10*a* is of a different amount (e.g., a different percentage increase). In most embodiments, at least one of braiding pattern and material of at least one of the cable insulator 16*a*, the cord insulator 18*a*, and the wire insulator 20*a*, correlates to the amount of increase in tensile strength of the cable 10*a*.

It is understood by a person skilled in the art that variations to the cable 10*a* as shown in FIG. 2 are provided by other embodiments of the present disclosure.

Figure 3:
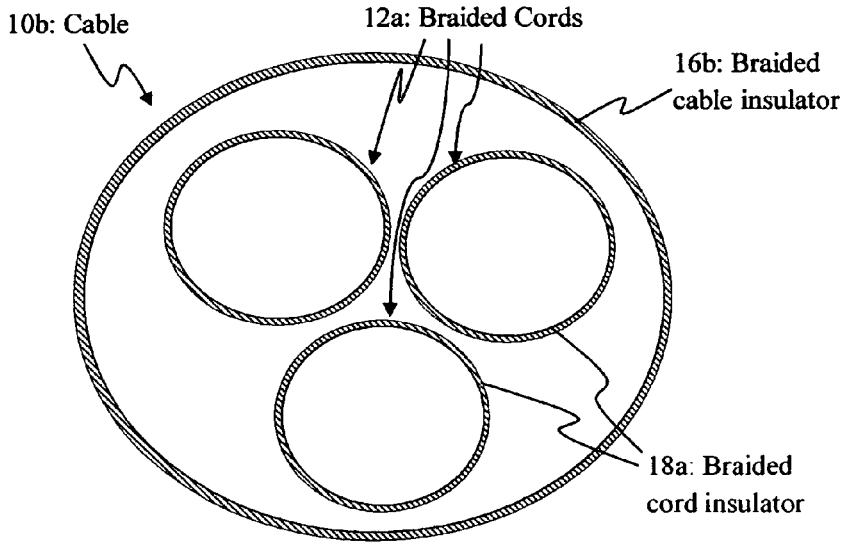
FIG. 3 shows another computer mouse cable according to a different embodiment of the present disclosure.

FIG. 3 shows another cable 10*b* provided by an embodiment of the present disclosure. The cable 10*b* shown in FIG. 3 includes a cable insulator 16*b*. The cable 10*b* further includes multiple wires 14*b* that are at least partly received or encapsulated within the cable insulator 16*b*. In some embodiments of the present disclosure, the cable 10*b* includes three wires 14*b*. In other embodiments of the present disclosure, the cable 10*b* includes four, five, six, or more wires 14*b*.

The cable 10*b* also includes wire insulators 20*b* that are shaped and dimensioned for at receiving or encapsulating at least a part of the wires 14*b*. The wires 14*b* of the cable 10*b* are braided or woven together in a predetermined braiding pattern, which can be varied as required. Each of the cable insulator 16*b* and the wire insulator 20*b* of the cable 10*b* shown in FIG. 3 is braided (i.e., each of the cable insulator 16*b* and the wire insulator 20*b* is manufactured from a braided material, or is considered a braided insulator). In most embodiments of the present disclosure, the material of each of the cable insulator 16*b* and the wire insulator 20*b* is selected as required, for example, based upon physical or chemical properties associated with that particular material. The braiding pattern of each of the cable insulator 16*b* and the wire insulator 20*b* can also be selected and varied as required. In most embodiments of the present disclosure, the braiding pattern of each of the cable insulator 16*b* and the wire insulator 20*b* is selected for enhancing at least one of flexibility and tensile strength of the cable 10*b*. In some embodiments of the present disclosure, the braiding pattern of each of the cable insulator 16*b* and the wire insulator 20*b* is selected for reducing propensity of kink formation to the cable 10*b*.

In most embodiments of the present disclosure, the braiding of the multiple wires 14*b* of the cable 10*b*, the cable insulator 16*b*, and the wire insulator 20*b* enhances the overall flexibility of the cable 10*b*. In some embodiments of the present disclosure, the braiding of the multiple wires 14*b* of the cable 10*b*, the cable insulator 16*b*, and the wire insulator 20*b* increases tensile strength of the cable 10*b*. In several embodiments of the present disclosure, the braiding of the wires 14*b* of the cable 10*b*, the cable insulator 16*b*, and the wire insulator 20*b* decreases propensity of kink formation in the cable memory, or reduces cable memory of the cable 10*b*.

Figure 4:
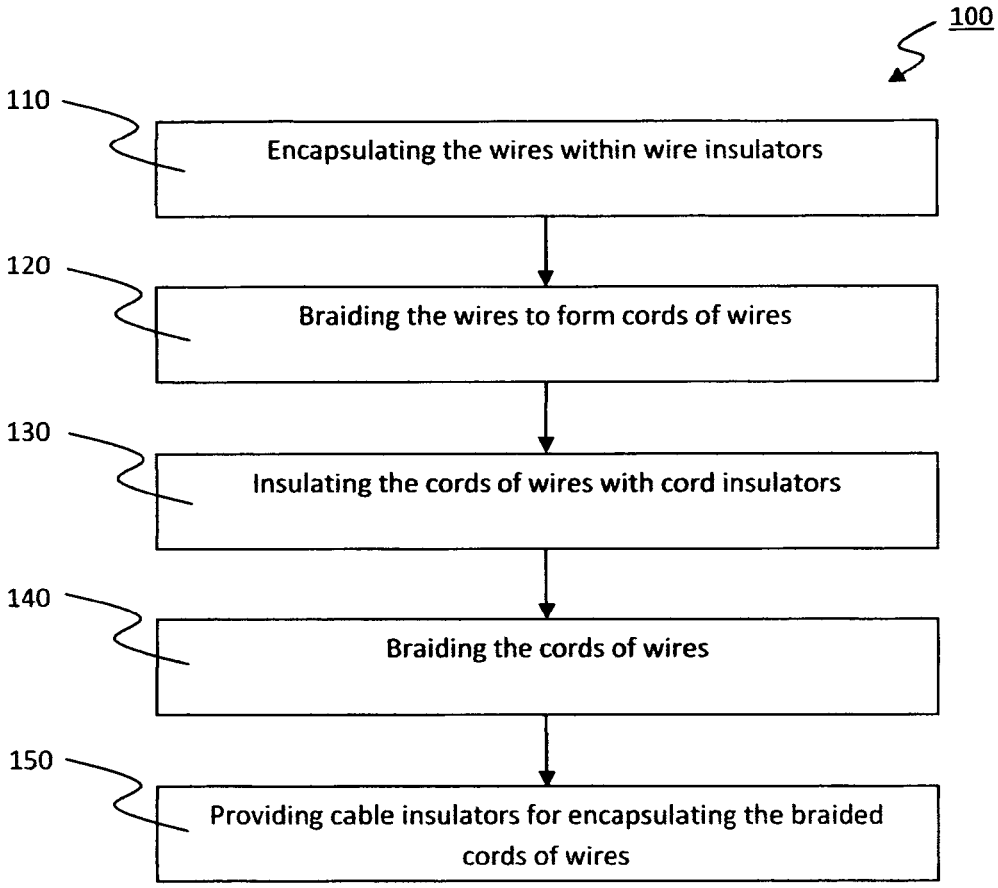
FIG. 4 shows another computer mouse cable according to a different embodiment of the present disclosure.

FIG. 4 shows another cable 10*c* provided by an embodiment of the present disclosure. As shown in FIG. 4, the cable 10*c* includes a cable insulator 16*c* and a number of cords of wires 12*c* that are encapsulated within the cable insulator 16*c*. Each cord of wires 12*c* includes multiple wires 14*c*. In some embodiments of the present disclosure, the cable 10*c* includes three cords of wires 12*c*. In other embodiments of the present disclosure, the cable 10*c* includes four, five, six, or more cords of wires 12*c*. In some embodiments of the present disclosure, each cord of wires 12*c* includes three wires 14*c*. In other embodiments of the present disclosure, each cord of wires 12*c* includes four, five, six, or more wires 14*c*.

The cable insulator 16*c* is braided (i.e., the cable insulator 16*c* is manufactured from a braided material, and is considered to be a braided insulator). The braiding pattern of the cable insulator 16*c* can be selected and varied as required. The multiple cords of wires 12*c* of the cable 10*c* shown in FIG. 4 are braided together in a predetermined braiding pattern. In addition, the multiple wires 14*c* of each cord of wires 12*c* are also braided together in a predetermined braiding pattern. The braiding patterns of the cords of wires 12*c*, and the wires 14*c* of each cord of wires 12*c*, can be selected and varied as required.

In most embodiments of the present disclosure, the braiding patterns of the cable insulator 16*c*, the cords of wires 12*c*, and the wires 14*c* of each cord of wires 12*c* are selected for enhancing at least one of flexibility and tensile strength of the cable 10*c*. In some embodiments of the present disclosure, the braiding patterns of the cable insulator 16*c*, the cords of wires 12*c*, and the wires 14*c* of each cord of wires 12*c* are selected for reducing propensity of kink formation to the cable 10*c*.

As with the embodiments shown in FIG. 2 and FIG. 3, the braiding of cable insulator 16*c*, the cords of wires 12*c*, and the wires 14*c* of each cord of wires 12*c* enhances the overall flexibility of the cable 10*c*. In some embodiments of the present disclosure, the braiding of cable insulator 16*c*, the cords of wires 12*c*, and the wires 14*c* of each cord of wires 12*c* increases tensile strength of the cable 10*c*. In several embodiments of the present disclosure, the braiding of cable insulator 16*c*, the cords of wires 12*c*, and the wires 14*c* of each cord of wires 12*c* decreases propensity of kink formation to the cable memory, or reduces cable memory of the cable 10*c*.

Figure 5:
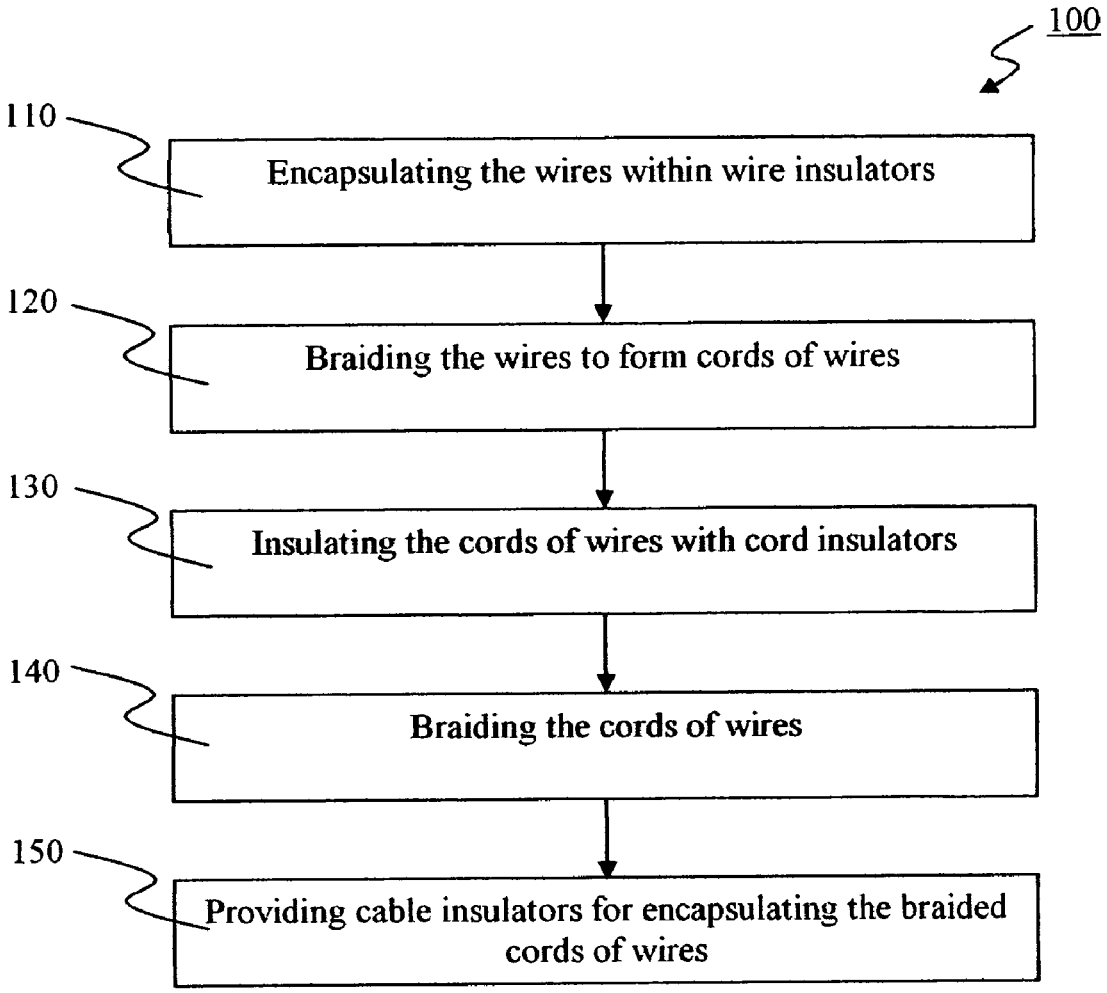
FIG. 5 is a flowchart illustrating a method for manufacturing the computer mouse cable according to an embodiment of the present disclosure as shown in FIG. 2.

FIG. 5 is a flowchart of a process 100 for manufacturing the cable 10*a* of FIG. 2 according to an embodiment of the present disclosure.

In a first process portion 110 of the process 100, each wire 14*a* of the cable 10*a* is at least partially surrounded by an individual wire insulator 20*a*. In many embodiments of the present disclosure, each wire 14*a* of the cable 10*a* is carried by or received within one wire insulator 20*a*. In some embodiments of the present disclosure, each wire 14*a* of the cable 10*a* is encapsulated within one wire insulator 20*a*. The wire insulators 20*a* help to insulate (e.g., electrically insulate) the wires 14*a*.

In most embodiments of the present disclosure, the wire insulator 20*a* is manufactured by a braiding or a weaving process (i.e., the wire insulator 20*a* is a braided wire insulator 20*a*). The braiding pattern of the wire insulator 20*a* can be selected and can be varied as required. In addition, the material of the wire insulator 20*a* can be selected as required, for example based on at least one physical or chemical property of the material.

In a second process portion 120, the wires 14*a* are braided or woven together in a predetermined pattern to form multiple cords of wires 12*a*. Each cord of wires 12*a* includes a subset of the wires 14 braided together in a predetermined braiding pattern. In some embodiments of the present disclosure, each cord of wires 12*a* includes three wires 14*a*. In other embodiments of the present disclosure, each cord of wires 12*a* includes four, five, six, or more wires 14*a*. It is understood by a person skilled in the art provided with the disclosure of the present description that different braiding processes or techniques can be employed for braiding the wires 14*a*. In most embodiments of the present disclosure, the braiding of the wires 14*a* enhances stability of the spatial arrangement or organization of the wires 14*a*. In most embodiments of the present disclosure, the braiding pattern of the subset of wires 14*a* of each cord of wires 12*a* is selected for enhancing at least one of flexibility and tensile strength of the cable 10*a*. In several embodiments of the present disclosure, the braiding pattern of the subset of wires 14*a* of each cord of wires 12*a* is selected for reducing propensity of kink formation to the cable 10*a*.

In a third process portion 130, each cord of wires 12*a* is at least partially surrounded or encapsulated by one cord insulator 18*a*. In most embodiments of the present disclosure, each cord of wires 12*a* is circumferentially received by one cord insulator 18*a*. In many embodiments of the present disclosure, each cord of wires 12*a* is encapsulated and insulated (e.g., electrically insulated) by one cord insulator 18*a*. As described above, the cord insulator 18*a* is braided (i.e., manufactured from a material that is braided) in a predetermined braiding pattern. The braiding pattern of the cord insulator 18*a* is selected, and can be varied, as required using techniques known in the art. In addition, the material of the cord insulator 18*a* can be selected as required, for example based on at least one physical or chemical property of the material.

In a fourth process portion 140, the multiple cords of wires 12*a* are braided together in a predetermined braiding pattern. As previously described, the braiding pattern of the multiple cords of wires 12*a* is selected, and can be varied, as required. Braiding of the multiple cords of wires 12*a* can be performed by braiding processes or techniques that are known in the art. In most embodiments of the present disclosure, the braiding of the multiple cords of wires 12*a* enhances stability of the spatial arrangement of the multiple cords of wires 12*a*. In most embodiments of the present disclosure, the braiding pattern of the cords of wires 12*a* is selected for enhancing at least one of flexibility and tensile strength of the cable 10*a*. In several embodiments of the present disclosure, the braiding pattern of the cords of wires 12*a* is selected for reducing a propensity of kink formation of the cable 10*a*.

In a fifth process portion 150, the cable insulator 16*a* is provided and the cords of wires 12*a* are collectively carried by the cable insulator 16*a*. In most embodiments of the present disclosure, the cable insulator 16*a* circumferentially carries the cord of wires 12*a*. In many embodiments of the present disclosure, the cable insulator 16*a* surrounds or encapsulates the cords of wires 12*a*. The cable insulator 16*a* is made of material that is braided or woven together in a predetermined braiding pattern (i.e., the cable insulator 16*a* is braided). The braiding pattern of the cable insulator 16*a* is selected, and can be varied, as required. In addition, the material of the cable insulator 16*a* can be selected as required, for example based on at least one physical or chemical property of the material.

In most embodiments of the present disclosure, the braiding pattern of at least one of the cable insulator 16*a*, the cord insulator 18*a*, and the wire insulator 20*a* is selected for enhancing at least one of flexibility and tensile strength of the cable 10*a*. In some embodiments of the present disclosure, the braiding pattern of at least one of the cable insulator 16*a*, the cord insulator 18*a*, and the wire insulator 20*a* is selected for reducing a propensity of kink formation of the cable 10*a*.

In most embodiments of the present disclosure, the method 100 enables the manufacture of cables 10*a* of an enhanced flexibility compared to existing cables 10*a*. The braided structure of the cords of wires 12*a*, and the individual wires 14*a* of each cord of wires 12*a*, enable the cords of wires 12*a*, and the individual wires 14*a* of each cord of wires 12*a*, to move slightly relative each other to thereby enhance the overall flexibility of the cables 10*a*.

Cables (such as the cables 10*a*, 10*b*, 10*c* provided by the present disclosure) with enhanced flexibility are increasingly desired, especially for computer garners wanting to make a quick and precise computer mouse movement for effecting a corresponding quick and precise movement to a pointer on the display screen. In some embodiments of the present disclosure, the method 100 enables manufacture of cables (such as cables 10*a*, 10*b*, 10*c* provided by the present disclosure) of significantly reduced propensity for kink formation (e.g., cables having a reduced cable memory). Reduced occurrence of kink formation in cables is increasingly desired for aesthetical reasons and typically increases the retail value of cables.

It will be understood by a person skilled in the art that the sequence of the process portions 110 to 150 can be altered as required. In addition, the process 100 according to an embodiment of the present disclosure can be modified for the manufacture of the cables according to other embodiments of the present disclosure, such as the cables 10*b* and 10*c* as shown FIG. 3 and FIG. 4. The process 100 can also be applied for manufacturing cables coupled or attached to other types of computer peripheral devices, and to other electrical appliances or devices.

In the foregoing disclosure, cables, for example cables attached to computer peripheral devices such as computer mice and headsets, and processes for the manufacture thereof, have been described. It will be appreciated by a person skilled in the art that the described process according to an embodiment of the present disclosure can be applied to other cables or cords, which can be attached to alternative electrical, mechanical, or electromechanical devices. In addition, although only exemplary cables and processes are described in this disclosure, it will be appreciated by a person skilled in the art in view of this disclosure that numerous changes and/or modifications, both structurally and functionally, can be made to the exemplary cables and process without departing from the scope, intention or spirit of the present invention.

The invention claimed is:

1. A cable comprising:

a braided cable insulator; and a plurality of cords spatially organized relative to each other in a predetermined braiding pattern, each cord of the plurality of cords having a braided cord insulator carrying a plurality of wires spatially organized relative to each other in a predetermined braiding pattern, at least one of the plurality of wires comprising a braided wire insulator, wherein the spatial organization of the plurality of cords, the braided cord insulator, the plurality of wires, the braided wire insulator, and the braided cable insulator at least one of enhances flexibility, increases tensile strength, and reduces a propensity of kink formation of the cable.

2. The cable as in claim 1, wherein the braided cord insulator of each cord of the plurality of cords has an identical braiding pattern.

3. The cable as in claim 2, wherein the predetermined braiding pattern of the plurality of wires of each cord of the plurality of cords is identical.

4. The cable as in claim 3, wherein a braiding pattern of each of the braided cable insulator, the braided wire insulator, the braided cord insulator, the plurality of wires carried by each braided cord insulator, and the plurality of cords at least one of enhances flexibility, increases tensile strength, and reduces a propensity of kink formation of the cable.

5. The cable as in claim 1, wherein the cable comprises one of a mouse cable, a USB cable, and a computer cable.

6. A cable comprising:

a plurality of cords braided together in a first braiding pattern, each cord within the plurality of cords comprising a braided cord insulator carrying a plurality of wires braided together in a second braiding pattern, at least one wire of the plurality of wires comprising a braided wire insulator, wherein the first braiding pattern of the plurality of cords and the second braiding pattern of the plurality of wires facilitate at least one of enhanced flexibility, increased tensile strength, and a reduced propensity of kink formation of the cable.

7. The cable as in claim 6, wherein the first and second braiding patterns are identical.

8. The cable as in claim 6, further comprising a braided cable insulator circumferentially receiving the plurality of cords of wires.

9. The cable as in claim 8, wherein each braided cord insulator has an identical braiding pattern.

10. The cable as in claim 9, wherein each wire within the plurality of wires comprises a corresponding braided wire insulator.

11. The cable as in claim 10, wherein the braided cable insulator, the plurality of cord insulators, and the plurality of wire insulators has a braiding pattern that at least one of enhances flexibility, increases tensile strength, and reduces a propensity of kink formation of the cable.

12. The cable of claim 11, wherein the braiding pattern of the braided cable insulator, the plurality of cord insulators, and the plurality of wire insulators are identical.

13. The cable as in claim 12, wherein the cable is one of a mouse cable, a USB cable, and a computer cable.

14. A method for manufacturing a cable, the method comprising:

braiding a plurality of cords in a predetermined pattern, wherein each cord of the plurality of cords comprises a braided cord insulator carrying a plurality of wires braided together in a predetermined pattern, providing a plurality of braided wire insulators, each braided wire insulator within the plurality of wire insulators at least partially surrounding one wire of the plurality of wires, providing a braided cable insulator for circumferentially receiving the plurality of cords therewithin, wherein the braiding of the plurality of cords, the braided cord insulator, the plurality of wires, the plurality of braided wire insulators, and the braided cable insulator facilitates at least one of enhancing flexibility, increasing tensile strength, and reducing a propensity of kink formation of the cable.

15. The method as in claim 14, wherein the plurality of wires of each cord of the plurality of cords is braided together in an identical braiding pattern.

16. The method as in claim 15, wherein the braided cord insulators of the plurality of cords have an identical braiding pattern.

17. The method as in claim 16, wherein the braided cable insulator, the plurality of braided cord insulators, and the plurality of braided wire insulators have a braiding pattern that at least one of enhances flexibility, increases tensile strength, and reduces a propensity of kink formation of the cable.

18. A computer peripheral device comprising:

a housing;

a set of transducers carried by the housing;

a set of electrical interfaces coupled to the set of transducers and carried by the housing; and a cable coupled to the set of electrical interfaces, the cable comprising:

a braided cable insulator; and a plurality of cords spatially organized relative to each other in a predetermined braiding pattern, each cord of the plurality of cords comprising a braided cord insulator carting a plurality of wires spatially organized relative to each other in a predetermined braiding pattern, at least one of the plurality of wires comprising a braided wire insulator, wherein the braiding pattern of the plurality of cords, the braided cord insulator, the plurality of wires, the braided cable insulator, and the braided wire insulator at least one of enhances flexibility, increases tensile strength, and reduces a propensity of kink formation of the cable.

19. The computer peripheral device as in claim 18, wherein the computer peripheral device comprises at least one of a computer mouse and a set of headphones.

* * * * *